US006941848B2

(12) United States Patent
Pedersen

(10) Patent No.: US 6,941,848 B2
(45) Date of Patent: Sep. 13, 2005

(54) PROCEDURE FOR THE PRODUCTION OF A BAR NOTCH

(75) Inventor: Agner Pedersen, Langa (DK)

(73) Assignee: DAN-LIST A/S Maskinfabrik, Randers (DK)

( * ) Notice: Subject to any disclaimer, the term of this patent is extended or adjusted under 35 U.S.C. 154(b) by 0 days.

(21) Appl. No.: 09/756,733

(22) Filed: Jan. 10, 2001

(65) Prior Publication Data

US 2002/0053269 A1 May 9, 2002

(30) Foreign Application Priority Data

Nov. 6, 2000 (DK) ..... 2000 01661

(51) Int. Cl.[7] ..... B26D 3/00; B26D 7/02

(52) U.S. Cl. ..... 83/39; 83/49; 83/468.6; 83/692; 83/917; 33/629

(58) Field of Search ..... 83/34–36, 39–50, 83/917, 920, 875, 468.6, 692, 668, 671, 683, 466.1, 468.7, 693, 468.5; 409/304, 336, 338, 347; 24/455–571; 33/468, 471, 500, 613, 619, 629

(56) References Cited

U.S. PATENT DOCUMENTS

| | | | | | |
|---|---|---|---|---|---|
| 1,274,605 | A | * | 8/1918 | Russell | 83/46 |
| RE15,496 | E | * | 11/1922 | Speer | 83/32 |
| 1,482,776 | A | * | 2/1924 | Abraham | 83/300 |
| 1,548,107 | A | * | 8/1925 | Street | 271/299 |
| 1,665,600 | A | * | 4/1928 | Mortimer | 52/518 |
| 1,666,204 | A | * | 4/1928 | Harshberger | 83/32 |
| 1,846,635 | A | * | 2/1932 | Finley | 229/75 |
| 3,097,684 | A | * | 7/1963 | Le Tart | 83/917 |
| 3,627,866 | A | * | 12/1971 | Laws | 83/35 |
| 3,664,011 | A | * | 5/1972 | Labastrou | 144/347 |
| 4,012,975 | A | * | 3/1977 | LaLone | 83/916 |
| 4,455,904 | A | * | 6/1984 | Havner et al. | 83/917 |
| 4,831,910 | A | * | 5/1989 | Poulsen | 83/917 |
| 4,907,383 | A | * | 3/1990 | Winter, IV | 52/86 |
| 5,052,256 | A | * | 10/1991 | Morrissey | 83/468 |
| 5,720,537 | A | * | 2/1998 | Lutz | 248/688 |
| 5,740,713 | A | * | 4/1998 | Korb | 83/582 |
| 5,794,501 | A | * | 8/1998 | Sasaki et al. | 83/34 |
| 5,873,292 | A | * | 2/1999 | Goese | 83/917 |
| 6,112,413 | A | * | 9/2000 | Frakes et al. | 30/229 |
| 6,283,668 | B1 | * | 9/2001 | Norek | 403/231 |
| 6,393,685 | B1 | * | 5/2002 | Collins | 29/416 |
| 6,675,686 | B2 | * | 1/2004 | Pedersen | 83/917 |
| 6,688,197 | B1 | * | 2/2004 | Niemela | 83/39 |

FOREIGN PATENT DOCUMENTS

| | | | | |
|---|---|---|---|---|
| FR | 723.340 | * | 4/1932 | 83/50 |
| GB | 2 015 911 A | * | 9/1979 | 83/49 |

* cited by examiner

*Primary Examiner*—Allan N. Shoap
*Assistant Examiner*—Jason Prone
(74) *Attorney, Agent, or Firm*—Dennison, Schultz, Dougherty & MacDonald

(57) ABSTRACT

A bar notch (3) in the side of a side member (1) and a shaping cut (4) at the end of a cross member (2) for the bar jointing of a side member (1) with a member (2) in workpieces of wood, plastics or MDF—medium density fiberboard—produced by a punching or shearing operation consisting of a first step—a preliminary cut—and a second step—a final cut. A machine for implementation of the cutting operation comprises a knife head (9) for two side knives (10) and a nose knife (11), a table (14) and a rest (13), a first set of adjustable guide members (17) that can set the position of the knife head (9) in relation to the workpiece (1) or (2) which is to be processed, a second set of adjustable guide members (23) for setting of the mutual distance between the cross member notches (3) and a third guide member (29), which can serve as an end stop for the end of the cross member (2) during the shearing process of a cross member shaping (4). Under the knives (10, 10, 11) the table (14) has an embedded dolly (34) of a soft material. The procedure is faster and less cumbersome than procedures used so far, where the cuts are produced by milling with rotating tools, which are difficult to adjust.

1 Claim, 9 Drawing Sheets

PROCEDURE FOR THE PRODUCTION OF A BAR NOTCH

BACKGROUND OF THE INVENTION

Procedure for the production of a bar notch in the side of a side member and a bar notch at the end of a cross member for a bar joint between a side member and a cross member, and a machine for the implementation of the procedure.

The present invention relates to a procedure for the production of a bar notch in a side member and a cross member notch at the end of a cross member in connections with notched joints of the kind mentioned in the pre-characterising part of claim 1.

Up to now, such notches have been produced by milling using a rotating tool. This procedure is slow and cumbersome, as the tool is difficult to adjust. Furthermore, machines with rotating tools are complicated in their construction and therefore expensive to produce.

SUMMARY OF THE INVENTION

It is the purpose of the present invention to describe a procedure for the production of cross member notches and side member notches by means of which the said drawbacks can be avoided.

This is achieved by the procedure described in the characterising part of claim 1.

BRIEF DESCRIPTION OF THE DRAWINGS

The invention is explained in detail below with reference to the drawing in which.

DETAILED DESCRIPTION OF THE INVENTION

Figure 1:
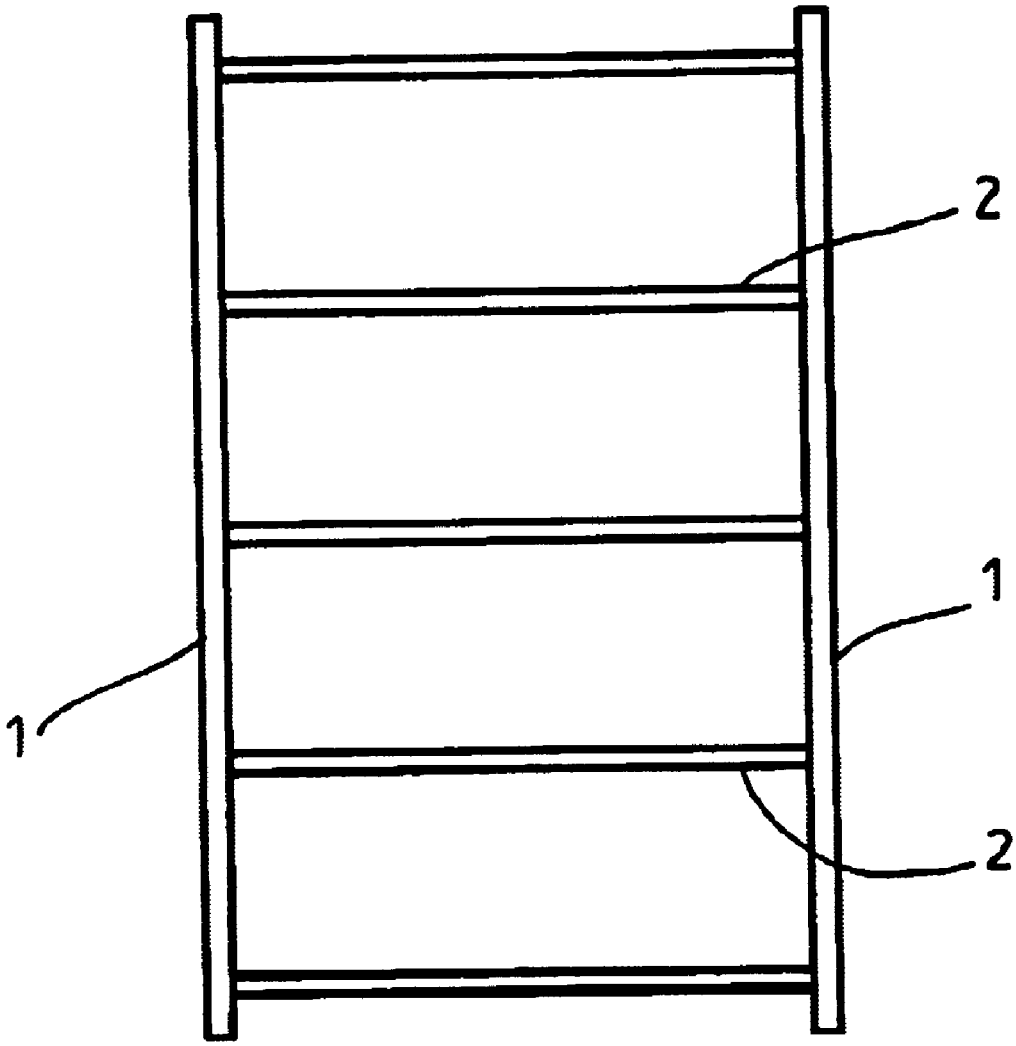
FIG. 1 is a schematic section of a frame made of two side members and a number of cross members.
Figure 2:
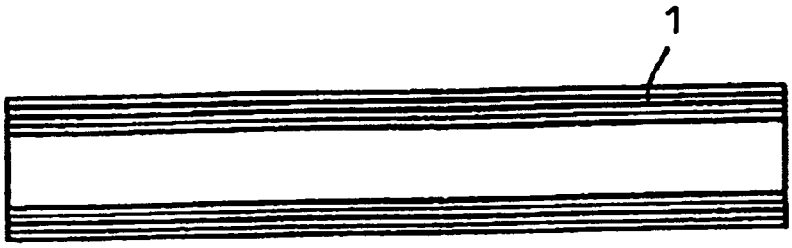
FIG. 2 is a top view of a section of a side member for a frame.
Figure 3:
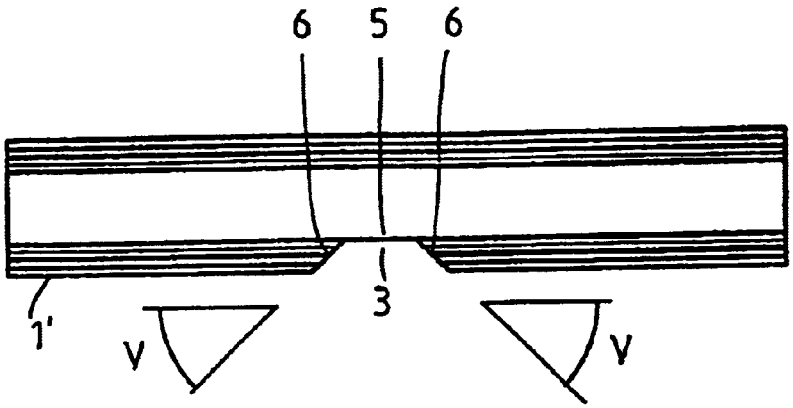
FIG. 3 is an illustration of the side member corresponding to the one in FIG. 2 with a bar notch.
Figure 4:
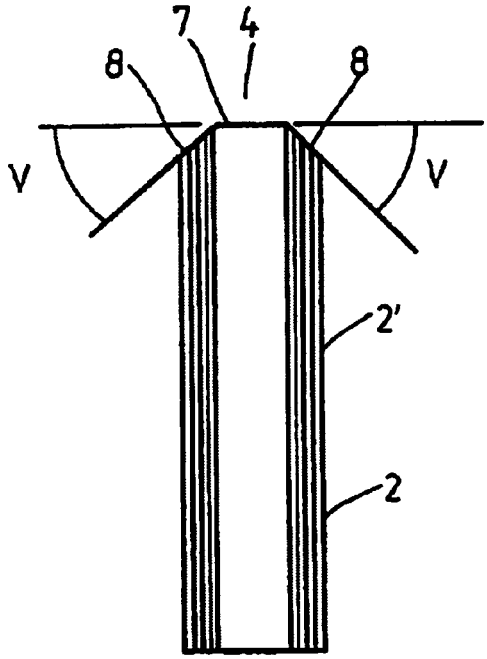
FIG. 4 is a top view of a cross member with a cross member notch.

As shown in FIG. 1–4 a frame, for example for doors or gates, consists of two side members 1 and a number of cross members 2. The side members 1 and the cross members 2 are joined in bar joints consisting of a bar notch 3 into the side of a side member 1 and a cross member notch 4 at the end of a cross member 2. A side member notch 3 can have a plane bottom 5, which is parallel with a side surface 1' of the side member 1 and two oblique sides 6, which are of equal length and which have two equally large oppositely directed inclines v in relation to the bottom 5. A cross member notch 4 consists of a plane end piece 7 at right angles to a side surface 2' in the member 2, and of two equally long oblique sides 8, which have two identical oppositely directed inclines v in relation to the plane end piece 7. The plane end piece 7 and the oblique sides 8 are of such a length that the shape of the cross member fits into the notch.

According to the invention a side member notch 3 and a cross member notch 4 are produced in a punching or shearing operation.

As shown in the drawings, FIGS. 5–10, a machine for the production of side member and cross member cuts by shearing comprises a triangular knife head 9—viewed from above —for two side knives 10 and a nose knife 11. The knife head 9 is movable in the vertical direction in a guide 12. This movement can be effected, for example, by means of a foot pedal (not shown), but it can also be done automatically, for example hydraulically. The guide 12 is movable in the horizontal direction on guide rails 12' (see FIG. 8) towards or away from a workpiece to be worked and which rests against a rest 13 on a table 14. This movement can be effected by activation of a handle 15 on an arm (not shown), and the setting can be read on a scale 16. This movement can also be automatic, for example hydraulic.

Figures 5, 6:
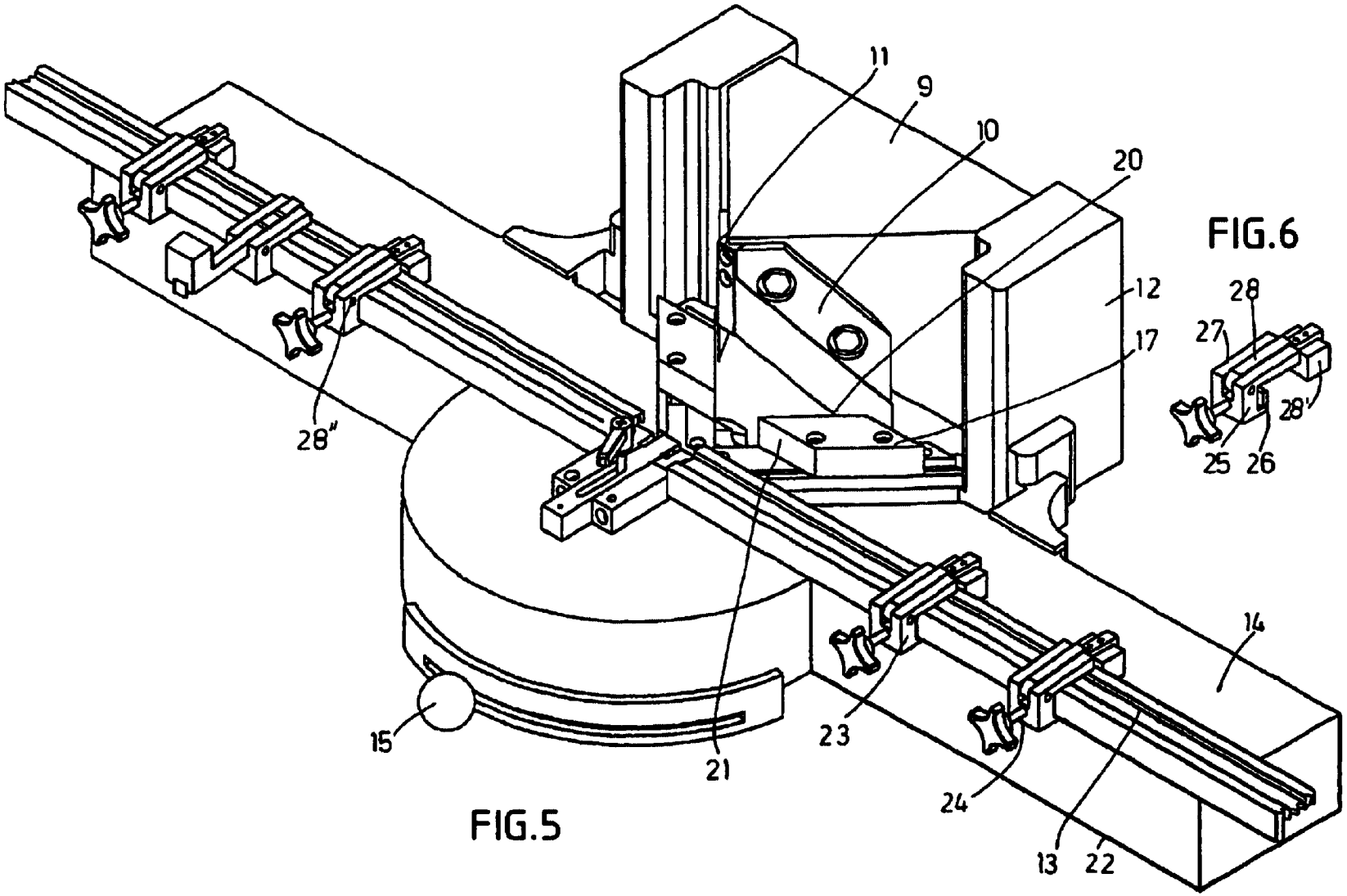
FIG. 5 is a perspective view of part of a machine for the implementation of the procedure according to the invention.
FIG. 6 shows a stop for a machine for the implementation of the procedure according to the invention.

As shown in FIG. 5, the machine comprises the first set of adjustable guide members 12 which can set the position of the knife head 9 in relation to the workpiece 1 or 2, which are to be processed, accurately during the shearing operation.

These guide members can consist of two stops 17, which each are displaceably mounted on a guide rail 18, and which are mounted by screws on the guide 12, each along its own side knife 10 and parallel with them. The stops 17 have an inside edge 20, which in its mounted position rests against the outside of the side knives 10 and a plane front side 21, which is parallel with the rest 13 and can come to rest against the workpiece 1 or 2, which is to be processed.

The machine also comprises a second set of adjustable guide members comprising a plurality of stops 23 for the setting of the distance between the bar notches, which are sheared into the side of a side member 1.

As shown in FIG. 5, the rest 13 is embodied as a guide rail with a vertical, longitudinal guide list 22 at the rear end. The second set of guide members consists of a number of stops 23, which are displaceable along the rest 13 and can be clamped to it by a knob-head bench screw 24. Each stop 23 has at its rear end—at the guide list 22—a lower part 25 with a U-shaped opening 26, which can accommodate the lower edge of the guide list 22, and a fork-shaped upper part 27, which in its mounted position reaches in over the whole width of the rest 13. An arm 28, which can be received in the fork 27, is at one end embodied with a stop 28' against which the end of a workpiece 1, which is to be processed, can come to rest. At the opposite end the arm 28 is swingably hinged to the fork-shaped upper part 27 by a pin 28", so that it can be swung over to a passive position.

Figure 7:
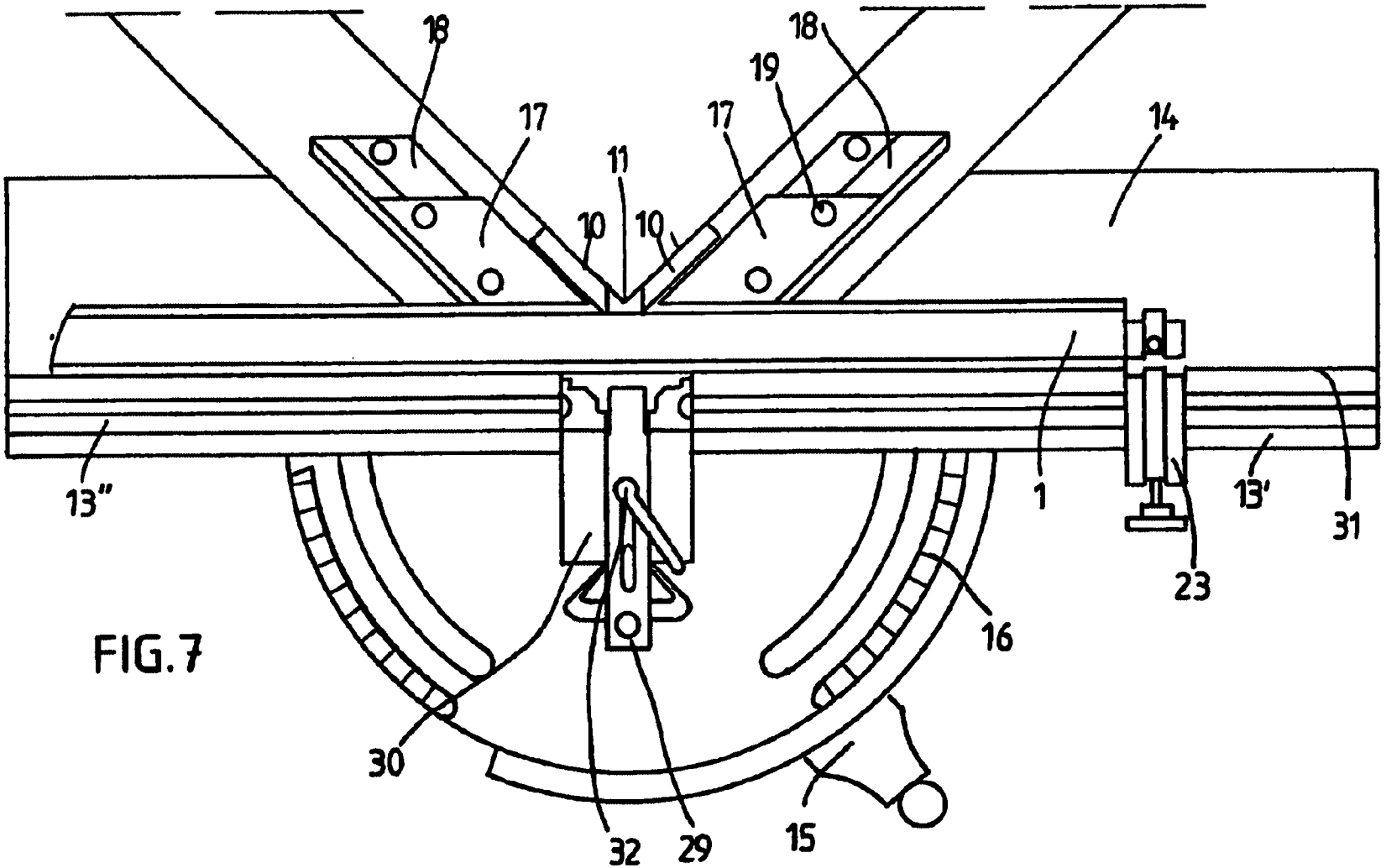
FIG. 7 is a top view of part of a machine for the implementation of the procedure according to the invention with a side member in position and the knife head moved forward during the shearing of a cross member notch.
Figure 8:
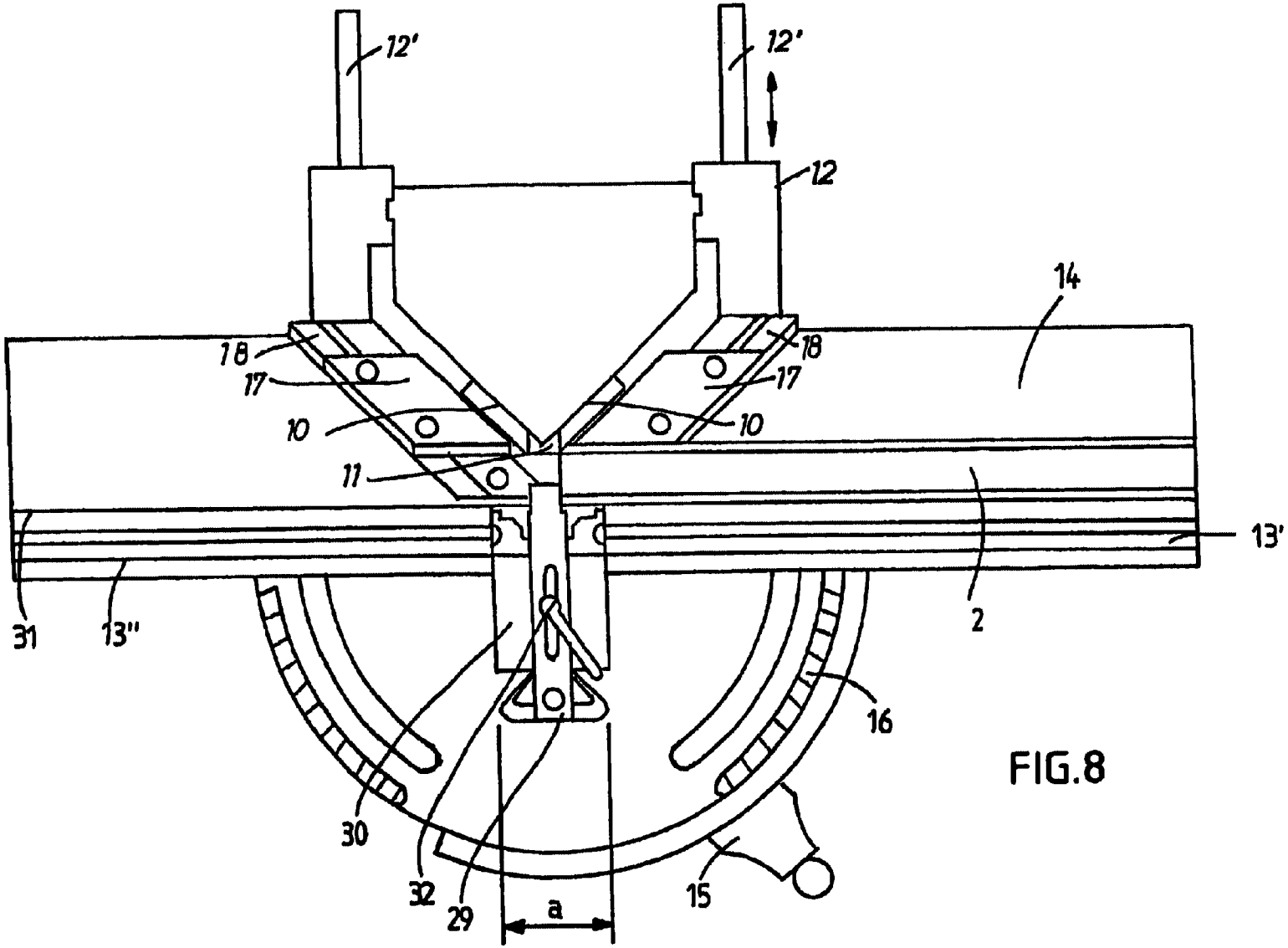
FIG. 8 is a top view of part of a machine for the implementation of the procedure according to the invention with a cross member in position during the shearing operation of a cross member notch.

As shown in FIGS. 7 and 8 the rest 13 is split up into a right-hand part 13' and a lefthand part 13", which off the centre of the knife head 9 are placed at a mutual distance (a). The third guide member consists of a catch 29, which can be moved crosswise to the rest 13 in a guide 30, which is mounted on the table 14 in the space (a). As shown the catch 29 can be displaced to adopt a forward working position in which it protrudes a distance forward over the front edge 31 of the rest 13, and in which it serves as a rest for the end of a cross member 2 during the punching of a cross member notch 4. From this position the catch 29 can be displaced to a retracted, passive position behind the front edge of the rest. The catch can be fixed to the table 14 by means of a clamping arrangement 32.

Figure 9:
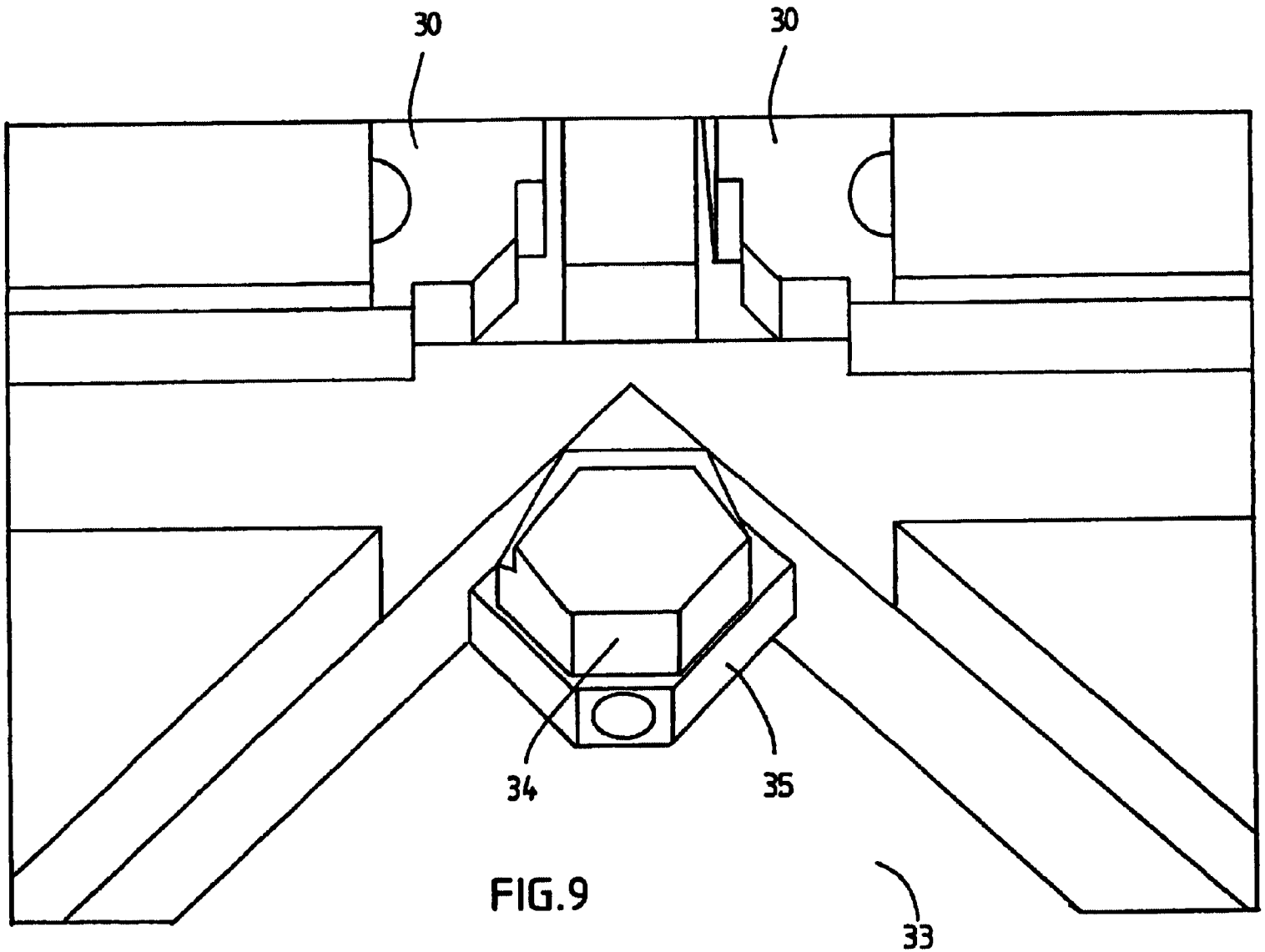
FIG. 9 is a perspective view of part of a machine for the implementation of the procedure according to the invention with the knife head removed.
Figure 10:
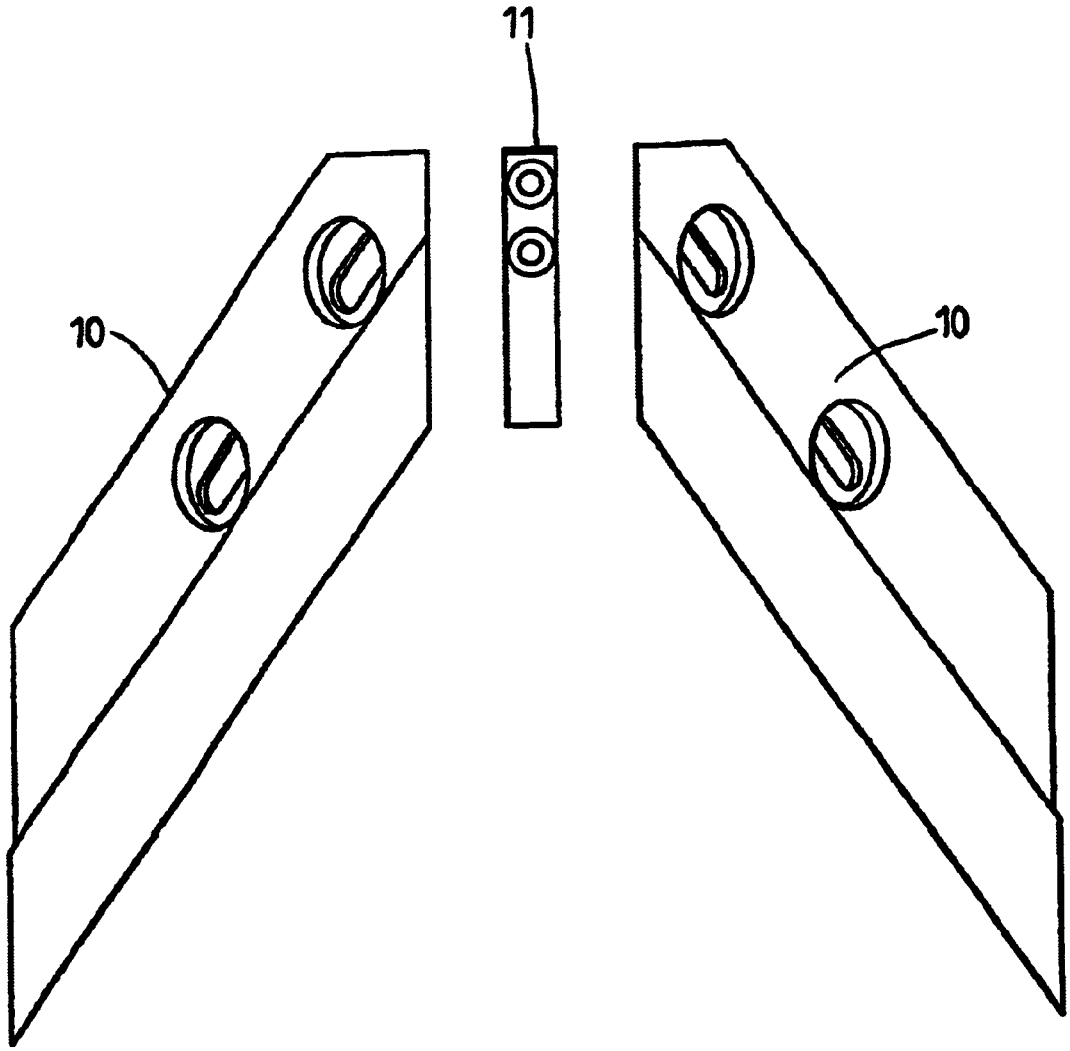
FIG. 10 is a perspective view of two side knives and a nose knife for a machine for the implementation of the procedure according to the invention.

As shown in FIG. 9 there is an indentation 33 in the table 14 under the set of knives 10, 10, 11. The cutting edge of the side knives 10 and the nose knife 11 can therefore in their bottom position be at a level with or slightly lower than the top side of the table 14. In the indentation 33 there is a detachably mounted dolly 34 of a soft material, e.g. of a synthetic material. The dolly 34 can be supported by and mounted on a plate member 35 screwed to the machine. The result is that a clean cut can be produced in the workpiece to be processed.

The nose knife 11 can be of the same width as the plane bottom 5 in a cross member notch 3. Consequently, there is no need to displace the bar 1 lengthways along the rest 13 during the shearing of a cross member notch 3.

Figure 12:
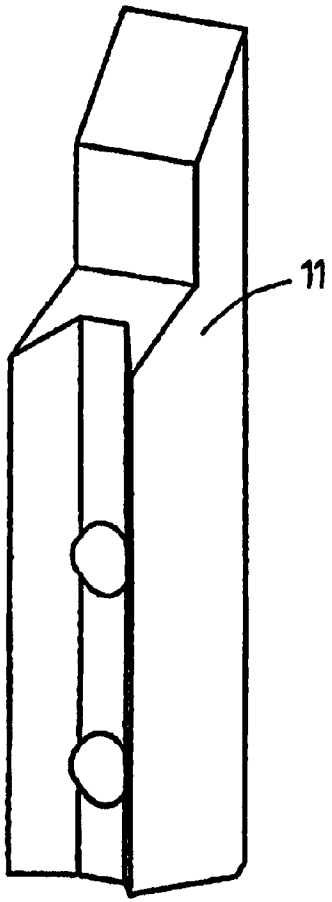
FIG. 12 shows the nose knife from another angle.
Figure 11:
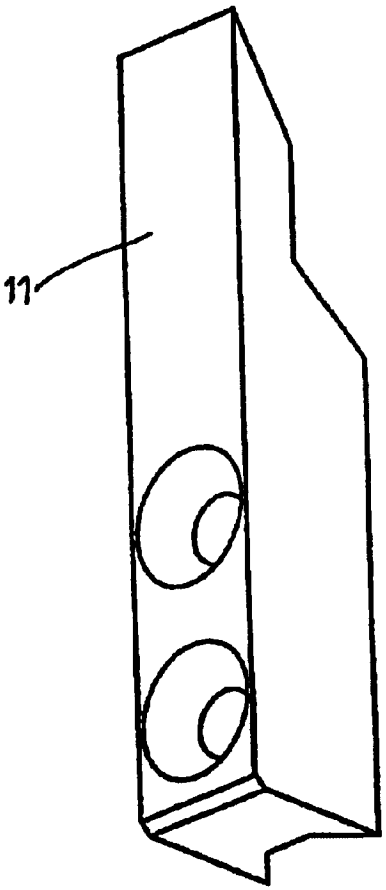
FIG. 11 is a perspective view of a nose knife, for a machine for the implementation of the procedure according to the invention.

The nose knife shown in FIGS. 11 and 12 with a V-shaped notch is employed for narrow workpieces.

When a shearing operation is started, the plane front side 21 of the guide stop 17 is held at a short distance from the side of the bar to be processed. In the final phase of the shearing operation, the front side 21 rests against the side of the workpiece 1 or 2.

Figure 13:
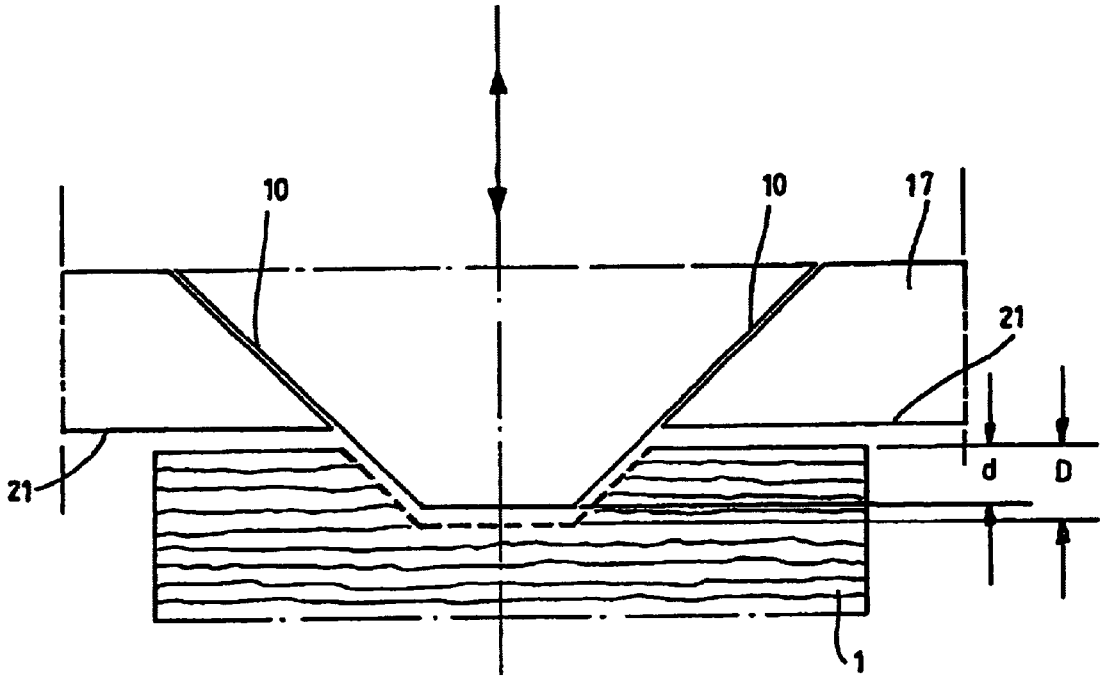
FIG. 13 is a large scale schematic top view of a side member bar notch and a part of a knife head for the production of the bar notch.
Figure 14:
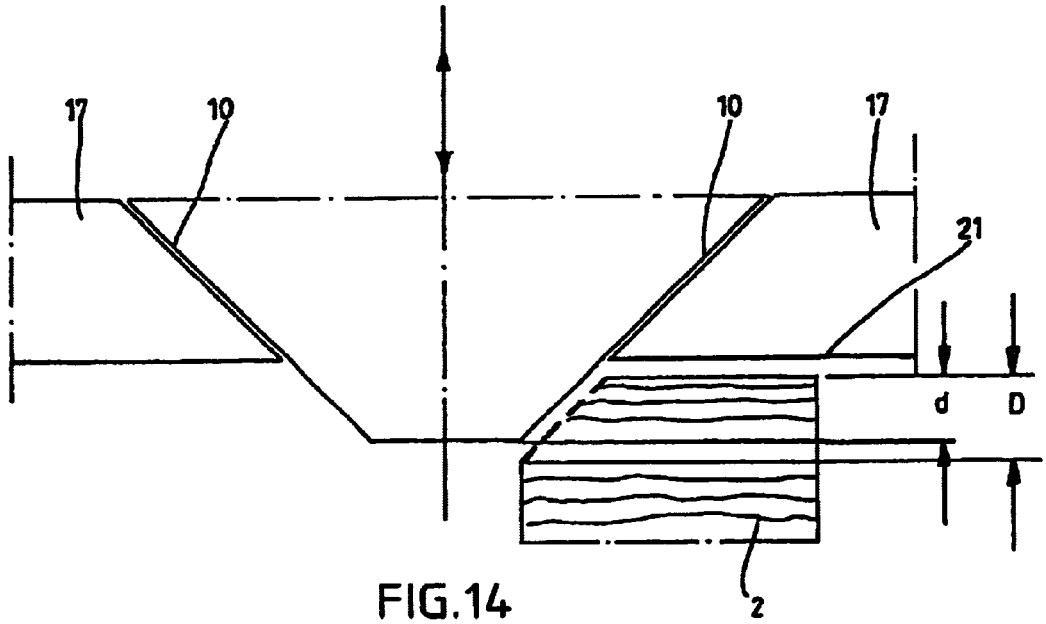
FIG. 14 is a large scale schematic top view of a bar notch at the end of a cross member and a part of a knife head for the production of a the bar notch.

As shown in FIG. 13, a preliminary shear is performed when the plane front side 21 of the stops 17 is in a short distance from the workpiece 1, and a preliminary bar notch is produced which is similar to the final bar notch produced at the final shear with oblique sides, parallel to the sides 6, and a bottom, which is parallel to the bottom 5, but where the depth d is less than the depth D of the final bar notch, and where the length of the oblique sides and the bottom are therefore less than the length of the oblique sides and the bottom respectively. By this preliminary shear, a bar notch is produced having sharp oblique sides and bottom by the final shear. Correspondingly, a preliminary cutout is produce by a preliminary shear of a bar notch at the end of a cross member which is similar to the final bar produced under the final shear. The preliminary cutout has a depth d less than depth D of the final shear and an oblique side which is parallel to the side 8 but it is slightly.

What is claimed is:

1. A method of producing a bar notch (3) in a side of a side member (1) and a cross member notch (4) on an end of a cross member (2) using an apparatus having a triangular knife head, a guide for slidably supporting said triangular knife head therewithin, said guide being movable in a horizontal direction, a table, a rest disposed on said table, a second guide disposed on said table, and a second guide member slidably disposed on said second guide and slidable in a direction crosswise to the rest, the method comprising the steps of:

preliminarily shearing or punching said side member (1) at a first depth (d) from a side surface (1') of said side member (1), preliminarily shearing or punching said cross member (2) at said first depth (d) from a side surface (2') of said cross member (2), and secondarily shearing or punching said side member (1) at a second depth (D) from said side surface (1') of said side member (1) to produce said bar notch (3) wherein said bar notch (3) includes a plane bottom (5), which is parallel with said side surface (1') in the side member and two equally long, oblique sides (6), which have oppositely direct equal inclinations in relation to the bottom (5) having an angle of less than 90°, and secondarily shearing or punching said cross member (2) at said second depth (D) from said side surface (2') of said side member (2) to produce said cross member notch (4), wherein the cross member notch has a plane end (7) in a cross member (2) and two inclined sides (8), wherein said first depth (d) of said preliminary shearing or punching of said side member (1) is less than but similarly oriented to said second depth (D) of said secondary shearing or punching of said side member (1), and wherein said first depth (d) of said preliminary shearing or punching of said cross member (2) is less than but similarly oriented to said second depth (D) of secondary shearing or punching of said cross member (2), whereby said side member can be joined with said cross member by the bar notch (3) fitting into said cross member notch (4).

* * * * *